US011059198B2

(12) United States Patent
Lu et al.

(10) Patent No.: US 11,059,198 B2
(45) Date of Patent: Jul. 13, 2021

(54) METHOD OF FORMING A COMPOSITE MATERIAL AND A COMPOSITE MATERIAL

(71) Applicant: City University of Hong Kong, Kowloon (HK)

(72) Inventors: Yang Lu, Tseung Kwan O (HK); Rong Fan, Tseung Kwan O (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/276,702

(22) Filed: Feb. 15, 2019

(65) Prior Publication Data

US 2020/0262099 A1 Aug. 20, 2020

(51) Int. Cl.

| | |
|---|---|
| ***B27N 3/04*** | (2006.01) |
| ***B27K 9/00*** | (2006.01) |
| ***B27N 7/00*** | (2006.01) |
| ***B27N 3/20*** | (2006.01) |
| ***B27N 3/18*** | (2006.01) |
| *B27N 1/02* | (2006.01) |

(52) U.S. Cl.

CPC ..... *B27K 9/002* (2013.01); *B27N 3/04* (2013.01); *B27N 3/183* (2013.01); *B27N 3/203* (2013.01); *B27N 7/005* (2013.01); *B27K 2240/10* (2013.01); *B27N 1/029* (2013.01)

(58) Field of Classification Search

USPC ..... 162/131; 156/264

See application file for complete search history.

(56) References Cited

U.S. PATENT DOCUMENTS

| | | | | |
|---|---|---|---|---|
| 4,091,153 | A | 5/1978 | Holman | |
| 4,680,214 | A | 7/1987 | Frisch et al. | |
| 4,810,551 | A | 3/1989 | Chu | |
| 5,023,097 | A * | 6/1991 | Tyson | A61L 15/28 127/37 |
| 5,916,105 | A | 6/1999 | Gow | |
| 6,098,679 | A * | 8/2000 | Go | B27N 7/00 144/2.1 |
| 7,337,544 | B2 | 3/2008 | Fagan et al. | |
| 7,537,669 | B2 * | 5/2009 | Jarck | B27N 1/00 156/264 |
| 2004/0094875 | A1 | 5/2004 | Estrada et al. | |
| 2009/0087656 | A1 * | 4/2009 | Plaehn | B29C 44/12 428/378 |
| 2009/0324876 | A1 | 12/2009 | Yang | |
| 2010/0028617 | A1 * | 2/2010 | Plaehn | E04C 2/18 428/182 |
| 2010/0143681 | A1 * | 6/2010 | Yano | B32B 27/20 428/216 |
| 2011/0308934 | A1 * | 12/2011 | Yang | C08B 3/06 204/157.62 |
| 2014/0000761 | A1 * | 1/2014 | Peng | D01B 9/00 144/3.1 |

OTHER PUBLICATIONS

Habibi, M., K., et al, "Asymmetric flexural behavior from bamboo's functionally graded hierarchical structure: Underlying mechanisms". Acta Biomaterialia, 2015, 16: 178-186.

Habibi, M., K., et al, "Crack propagation in bamboo' s hierarchical cellular structure". Science Reports, 2014, 4: 1-7.

Habibi, M., K., et al, "Viscoelastic damping behavior of structural bamboo material and its microstructural origins". Mechanics ofMaterials, 2016, 97: 184-198.

Zou, M., et al, "A bionic method for the crashworthiness design of thin-walled structures inspired by bamboo". Thin-Walled Structures, 2016, 101 : 220-230.

R. Guan, et al, "Microcellular thin PET sheet foam preparation by compression molding". Journal of Applied Polymer Science, 2004, 93: 1698-1704.

R. Burgueno, et al, "Load-bearing natural fiber composite cellular beams and panels". Composites Part A: Applied Science and Manufacturing, 2004(35): 2004.

R. Burgueno, et al, "Hierarchical cellular designs for load-bearing biocomposite beams and plates". Materials Science & Engineering A. 2005(390): 178-187.

* cited by examiner

*Primary Examiner* — Mark Halpern

(74) *Attorney, Agent, or Firm* — Renner Kenner Greive Bobak Taylor & Weber

(57) ABSTRACT

A method of forming a composite material includes: a) providing a substrate with fibres, lignin and hemicellulose; b) partially removing the lignin and hemicellulose from the substrate; and c) compressing the remaining substrate to form a compressed substrate. A composite material formed by the method is also provided.

25 Claims, 12 Drawing Sheets

METHOD OF FORMING A COMPOSITE MATERIAL AND A COMPOSITE MATERIAL

TECHNICAL FIELD

The present disclosure relates to a novel method of forming a composite material and a composite material formed by the same, and particularly, although not exclusively, to a method of forming a green composite material (or "eco-composite") material and a green composite material that may be useful from construction industry to household articles. However, it will be appreciated that the composite material of the present disclosure is not limited to this particular field of use.

BACKGROUND

The development of economy in a sustainable manner remains a world-recognized challenge. Green structural materials may offer an alternative to plastics or metals as well as bring a lower environmental impact. Among the current green structural materials, bamboos may be one of the affordable low cost and renewable resources.

Although the low-cost and environmentally-friendly nature of green structural materials may possibly replace plastics or metals in some engineering applications, its overall mechanical performance yet remains unsatisfactory and thus it is not suitable for advanced engineering structures and applications.

SUMMARY OF THE PRESENT INVENTION

In accordance with a first aspect, the present disclosure relates to a method of forming a composite material comprising:

a) providing a substrate with fibres, lignin and hemicellulose;

b) partially removing the lignin and hemicellulose from the substrate; and c) compressing the remaining substrate to form a compressed substrate.

In an embodiment, step b) includes step b1) of subjecting the substrate under an alkaline condition.

In an embodiment, step b1) includes immersing the substrate with an alkaline solution.

In an embodiment, step b) includes step b2), following step b1), of removing the alkali from the substrate for separating the lignin and hemicellulose from the fibres.

In an embodiment, the method further includes step d), following step b), of aligning at least two said substrates in a stacked manner.

In an embodiment, step d) includes step d1) of stacking one of the two substrates onto the other with the fibres oriented substantially in a parallel arrangement.

In an embodiment, step d) includes step d2) of stacking one of the two substrates onto the other with the fibres oriented substantially in a staggered arrangement.

In an embodiment, step c) includes step c1) of pressing the substrates under a heated condition.

In an embodiment, the stacked substrates are bonded together by hydrogen bond formed between adjacent fibres.

In an embodiment, the method further includes step e), following step c), of deburring the edge of the compressed substrate.

In an embodiment, the method further includes step f), following step c), of applying an oil coating onto the surface of the compressed substrate.

In an embodiment, the substrate is immersed in a mixture of NaOH and $Na_2SO_3$ for 6-10 hours.

In an embodiment, the substrate is immersed into a boiling deionized water for at least 3 times.

In an embodiment, the stacked substrates are pressed at 100-130° C. under a pressure of 5 MPa for 24 hours.

In a second aspect, the present disclosure relates to a composite material formed by the method of forming a composite material of the present invention.

In an embodiment, the adjacent substrates are bonded to each other by adjacent fibres therein.

In an embodiment, the adjacent substrates are bonded together by hydrogen bond formed between the adjacent fibres.

In an embodiment, the fibres of the adjacent substrates are oriented substantially at 0° with respect to each other.

In an embodiment, the fibres of the adjacent substrates are oriented substantially at 90° with respect to each other.

In an embodiment, the fibres are arranged longitudinally along the length of the substrate.

In an embodiment, the composite material comprises a fibre density of at least 1300 $kg/m^3$.

In an embodiment, the substrate is a natural material.

In an embodiment, the natural material is bamboo and the fibres are bamboo fibres.

In connection with dimensions, the term approximately should be understood to mean within standard manufacturing tolerances or deviations that result and/or can be expected during manufacturing. In addition, the term approximately can extend up to and including dimensions that would round to the stated value.

The terms "generally" or "substantially" should be understood to mean "for the most part." For example, a component that is generally cylindrical need not necessarily conform to a perfect cylinder (a surface or solid bounded by two parallel planes and generated by a straight line moving parallel to the given planes and tracing a curve bounded by the planes and lying in a plane perpendicular or oblique to the given planes). Rather, a generally cylindrical component should be understood to be cylinder-like in that it has a circular profile along a cross-section and an elongate longitudinal profile.

The term "comprising" (and its grammatical variations) as used herein are used in the inclusive sense of "having" or "including" and not in the sense of "consisting only of".

DETAILED DESCRIPTION OF THE PREFERRED EMBODIMENT

Figure 1:
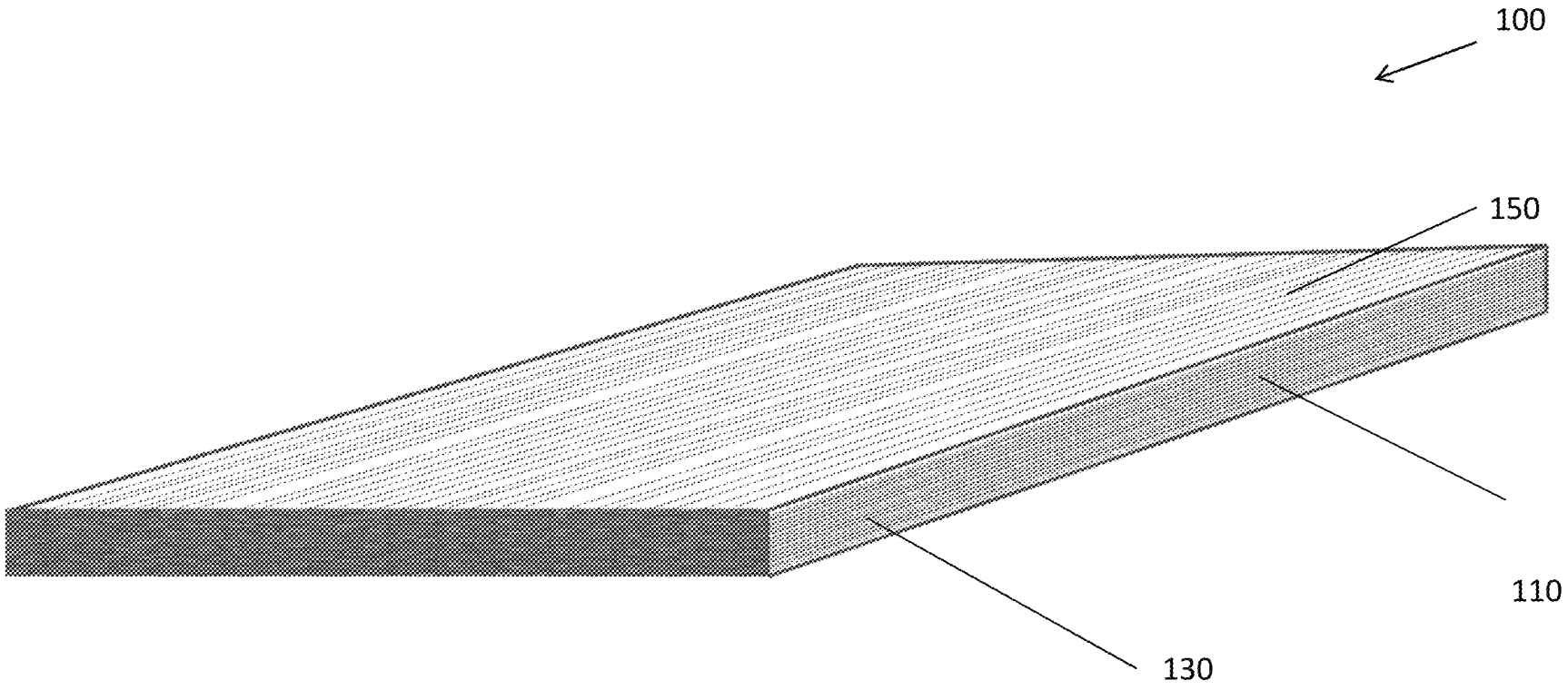
FIG. 1 shows an embodiment of a composite material comprising a substrate with a plurality of fibres.

Without wishing to be bound by theories, the inventors, through their own trials and experiments, have devised that existing strand bamboo plate manufacturing method although provide a desirable strength, yet it has certain shortcomings which is fatal and restricted the field of application.

For instance, the strip-shaped bamboo composite materials are not adhesive and are therefore superposed and glued one with respect to another. Additional glue, like phenolic resin, is involved to enhance the adhesive strength of each piece. However, it may result in hazardous chemical residue, to affect and limit the further application of such bamboo materials.

In addition, the mechanical performance of raw bamboo is unsatisfactory for many advanced engineering structure and applications. Traditional pre-treatment with cold rolling or hot rolling process can enhance the mechanical performance. However, it results in incomplete densification and the rolled bamboo material lacks dimensional stability. The rolled bamboo materials may therefore be used only for low load bearing applications.

Furthermore, the existing strand bamboo plate manufacturing method poses a strong requirement on the quality and the size of the natural bamboo to be used. However, the shapes of each bamboo would not be symmetrical and thus the alignment of the bamboos would be imperfect, which limits the overall strength of the bamboo materials.

The foregoing describes only some embodiment of the present invention and modifications, obvious to those skilled in the art, can be made thereto without departing from the scope of the present invention.

The present invention provides a method of forming a composite material 100/200 comprising: a) providing a substrate 112 with fibres 130, lignin 142 and hemicellulose 144; b) partially removing the lignin 142 and hemicellulose 144 from the substrate 112; and c) compressing the remaining substrate 112 to form a compressed substrate 110.

The present disclosure is directed to a new method to produce highly scalable densified bamboo material with excellent mechanical performance for many structural applications. This process involves the partial removal of lignin 142 and hemicellulose 144 in an alkali solution followed by hot pressing.

Bamboo culm mainly consists of xylem vessels, parenchyma cells 140, and fibre bundles 130. By using the present method, the xylem vessels and parenchyma cells 140 in bamboo culm can be fully compressed without cracks. The obtained high densified bamboo has excellent strength and toughness, which is competitive with metals and its alloys.

Figure 5A:
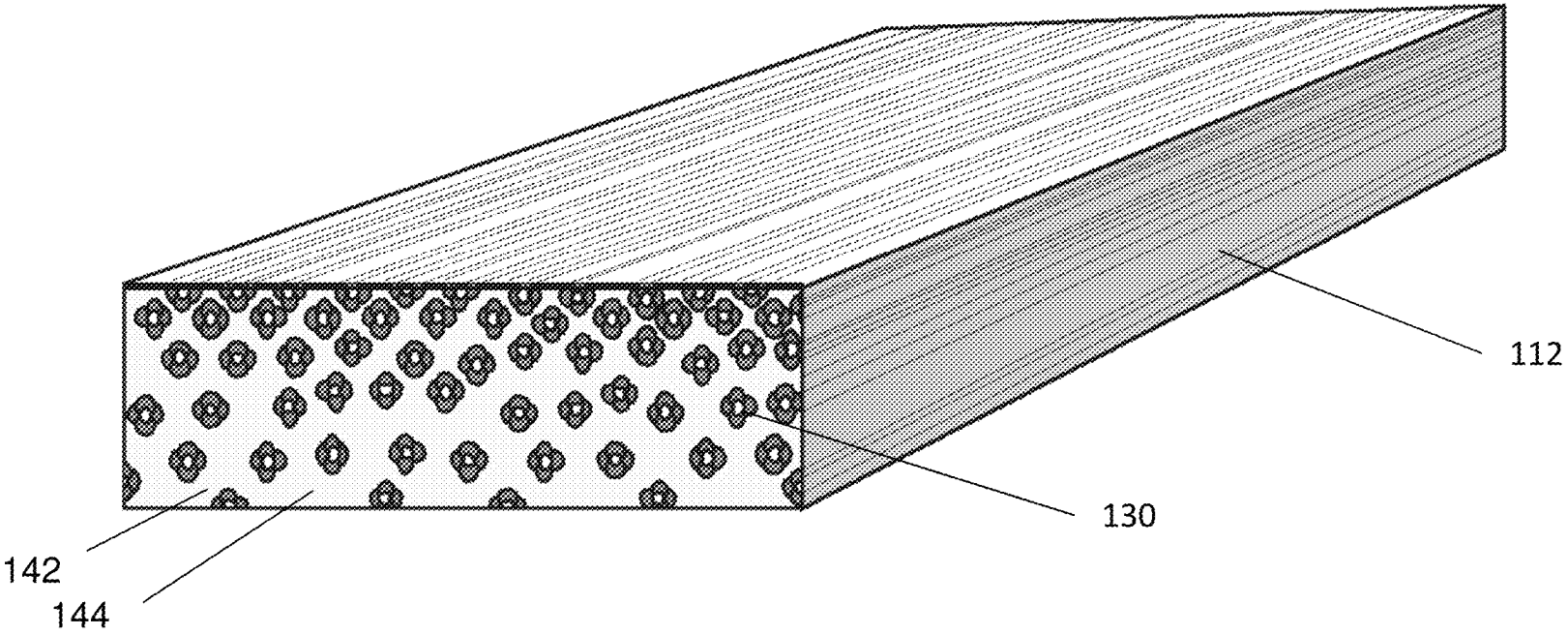
FIG. 5*a* is a schematic diagram of raw bamboo with microstructure, showing different constituents and functionally graded structure.
Figure 5B:
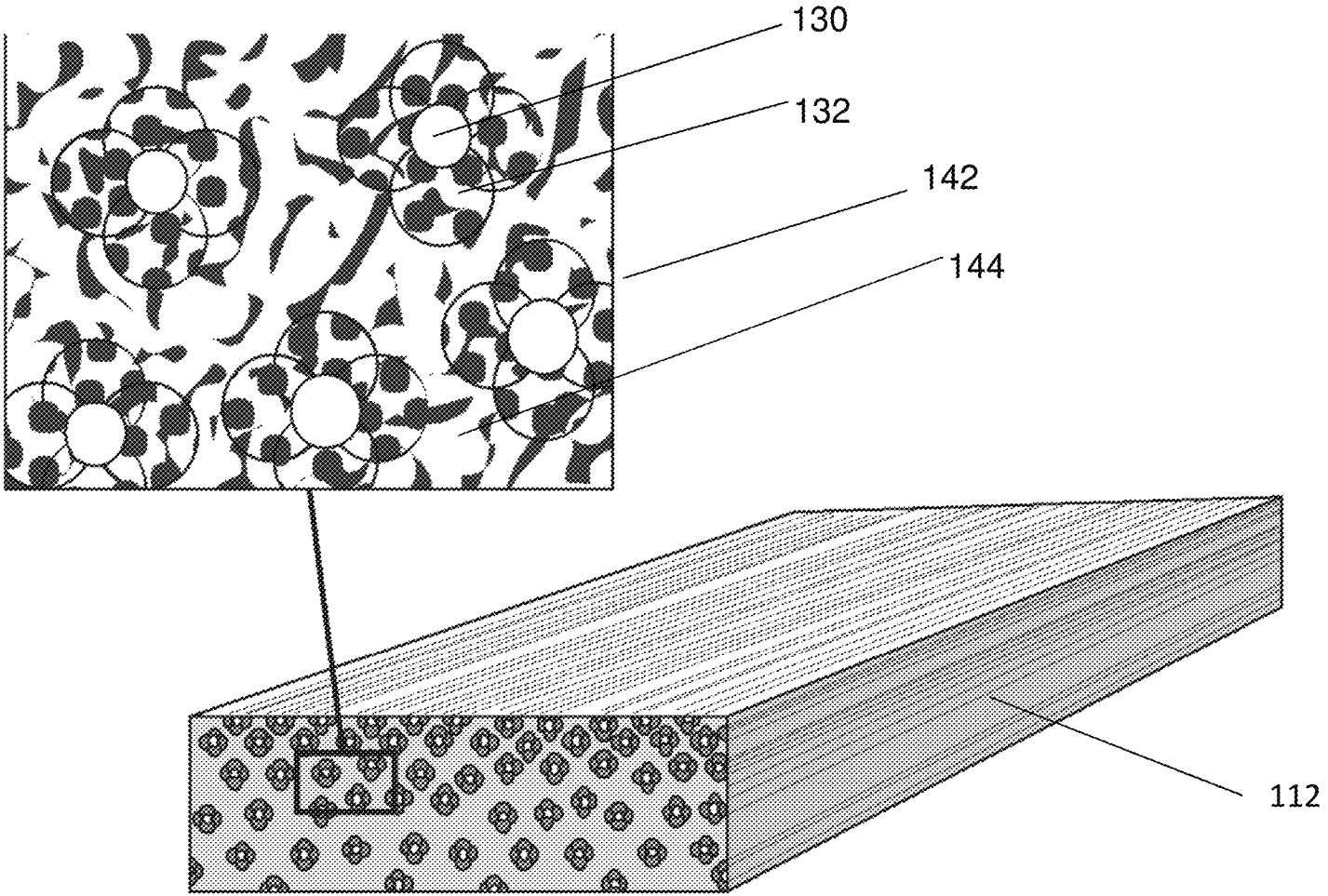
FIG. 5*b* shows the bamboo strips are immersed in a boiling alkali solution of mixed NaOH and $Na_2SO_3$.

FIG. 1 shows an embodiment of a composite material 100. The composite material 100 includes a substrate 110 e.g. formed by a natural material such as bamboo in which a plurality of fibres 130 e.g. bamboo fibres is positioned parallel to each other and oriented longitudinally along the length of the substrate 110. In the raw substrate 112 (as shown in FIGS. 5*a* and 5*b*), the fibres 130 are initially surrounded by the lignin 142 and hemicellulose 144.

In preparing the composite material 100, substrate 112 is initially subjected to an alkaline condition. For instance, the substrate 112 is immersed with an alkaline solution for removing the lignin 142 and hemicellulose 144. The alkaline solution is then removed from the substrate 112 for separating at least a portion of the lignin 142 and hemicellulose 144 from the fibres 130 to reduce the structure complexity of the substrate 112. The substrate 112 is then subjected to compression to form a compressed substrate 110 e.g. a densified bamboo (as shown in FIG. 1).

Figure 2:
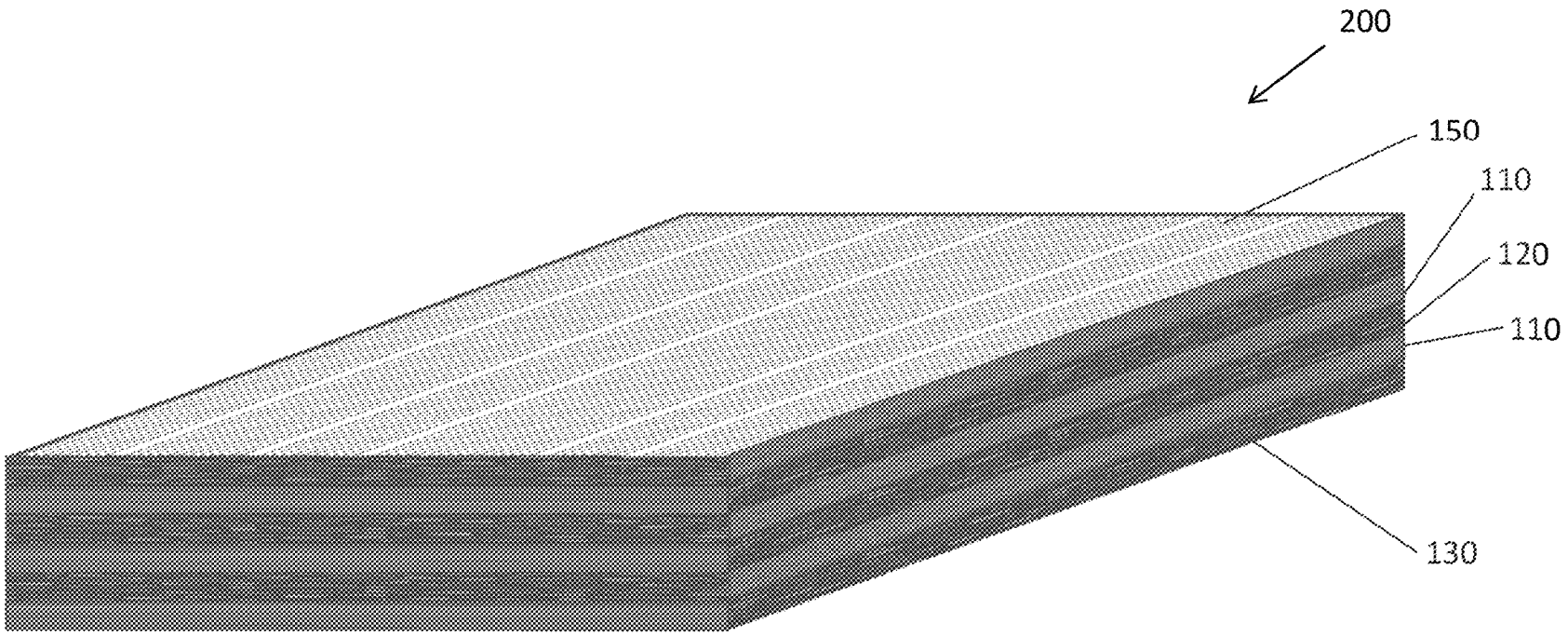
FIG. 2 shows an embodiment of a composite material comprising multilayer of substrates.

FIG. 2 shows an embodiment of a composite material 200. The composite material 200 comprises a plurality of substrates 110. Before compression, the plurality of substrates 112 e.g. bamboo strips is stacked in a specific structural arrangement for reinforcing the strength of the composite material 200 in one or more planar directions. For instance, to strengthen the densified bamboo, the multilayer bamboo strips 112 may be laminated with fibres 130 orientation alternating by 0° or 90° from layer to layer, thereby obtaining a multilayer densified bamboo with fibres 130 orienting substantially in a parallel arrangement or in a stagger arrangement.

Each of the two adjacent substrates 112 are adhered together by an adhesive layer 120. Under a heated compression, the fibres 130 on the adjacent substrates 112 would eventually melt and the melted fibres 130 on the adjacent substrates 112 together form a bonding force e.g. hydrogen bond therebetween. The adjacent substrate 112 and the adhesive layer 120 are provided by the same material i.e. the bamboo. Meanwhile, the stacked substrates 112 are compressed to form multilayer of compressed substrate 110.

The compressed multilayer substrate 210 may have a rough finishing and permeable or vulnerable to fluids. Therefore, surface treatment may be applied onto the surface of the substrate 210 to enhance its durability. This includes removing burrs on the edges of the substrate 210 as well as applying a watertight layer or coating onto the surface of the substrate 210.

Figure 3:
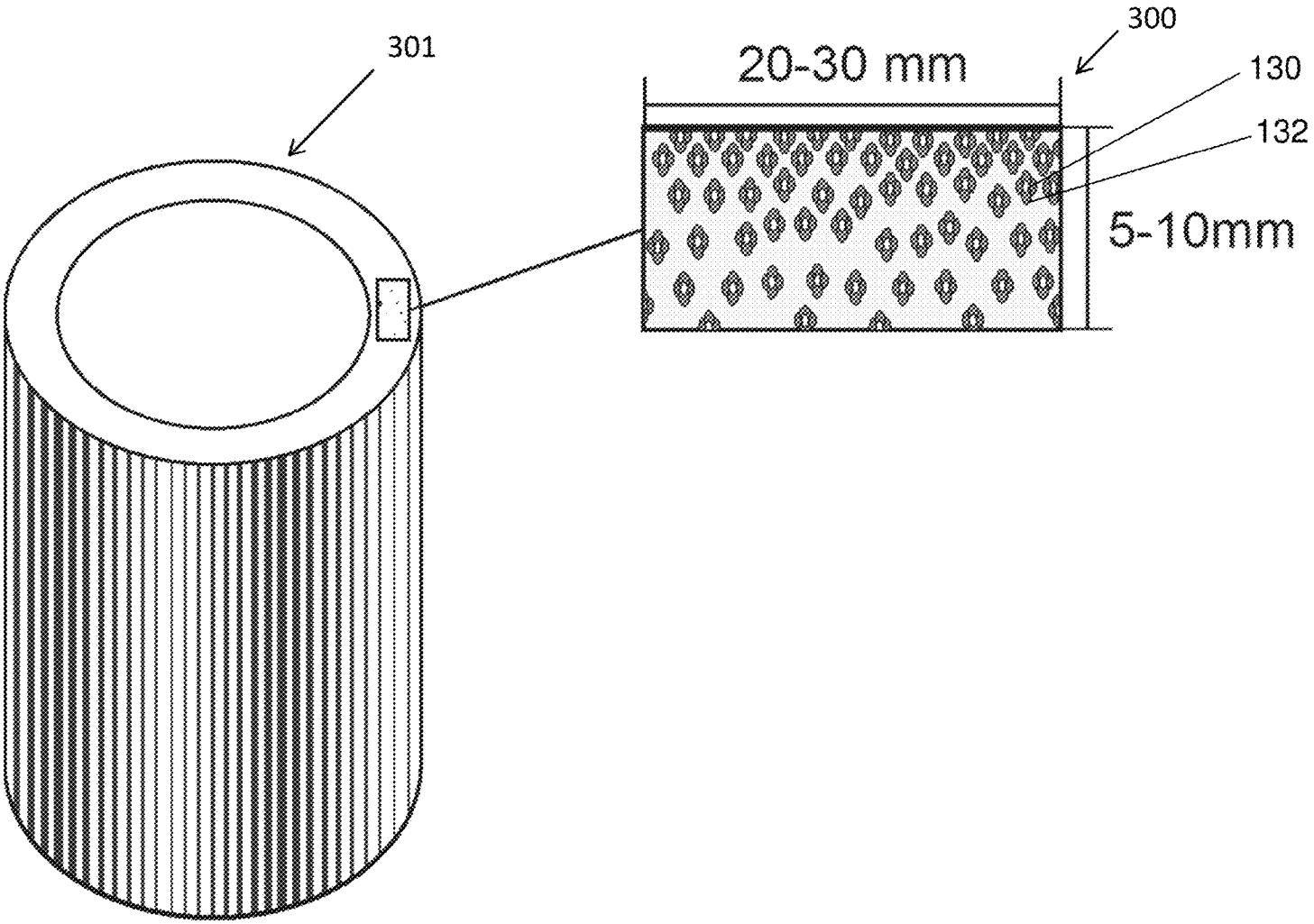
FIG. 3 shows a detailed view of the fibre distribution in a bamboo culm.

FIG. 3 shows a detailed view of a bamboo strip 300 illustrating the fibre distribution in a bamboo culm or pipe 301. A raw bamboo contains vessels and fibre bundles 130. Fibres 130 are arranged along the same direction but distributed by hierarchical characterization in different layers.

The bamboo strip 300 in FIG. 3 includes a hierarchical functionally graded structure. Fibres 130 are densely distributed in or more tightly packed toward the outer portion or outer side of the culm 300 whilst sparsely dispersed in the inner portion or inner part. Each fibre 130 is positioned within and received by a plurality of hollow pockets 132.

The rest of the culm 300 is parenchyma cells 140. This exhibited graded distribution of fibres 130 and parenchyma cells 140 naturally arouses a functionally gradient mechanical behaviour along the thickness of the bamboo culm 300.

Figure 4A:
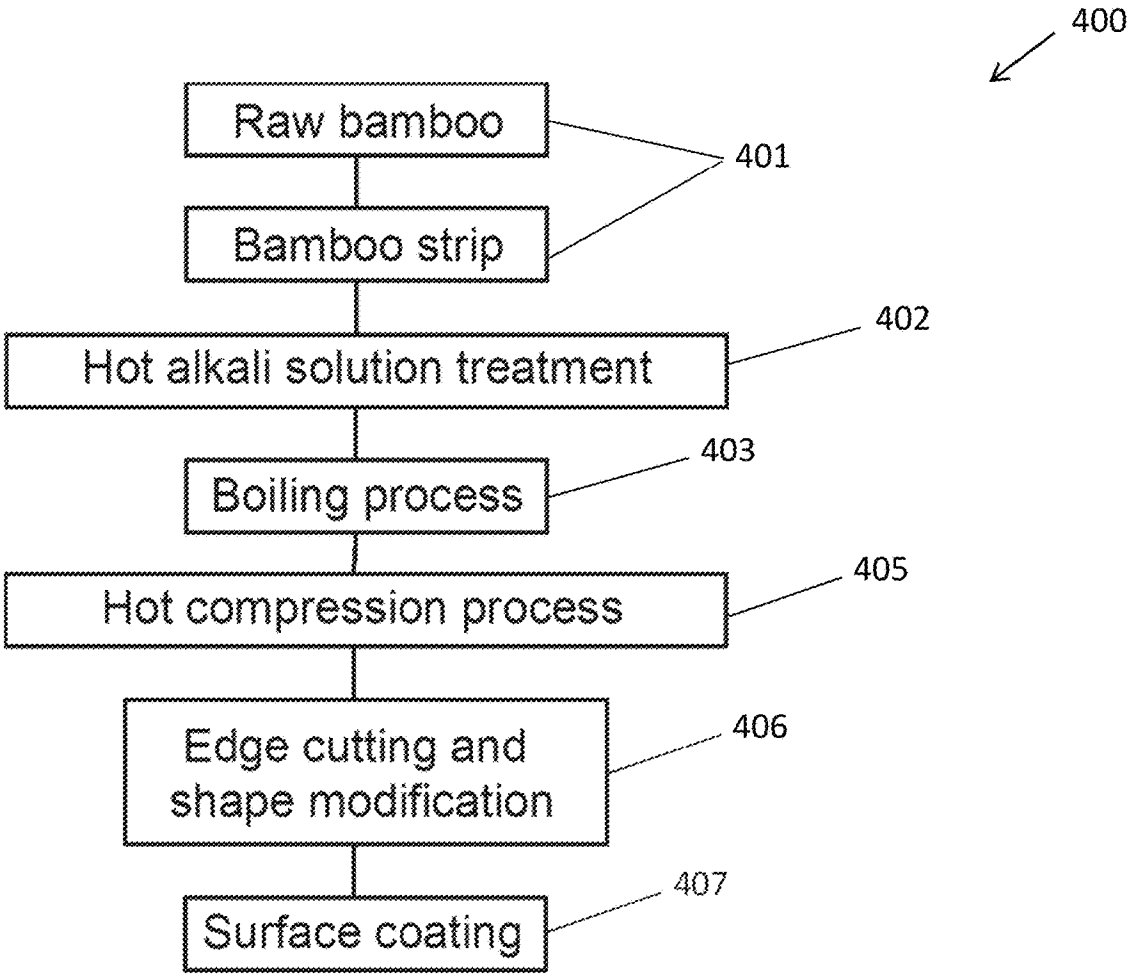
FIG. 4*a* shows a flow chart of the manufacturing process of composite material shown in FIG. 1.
Figure 4B:
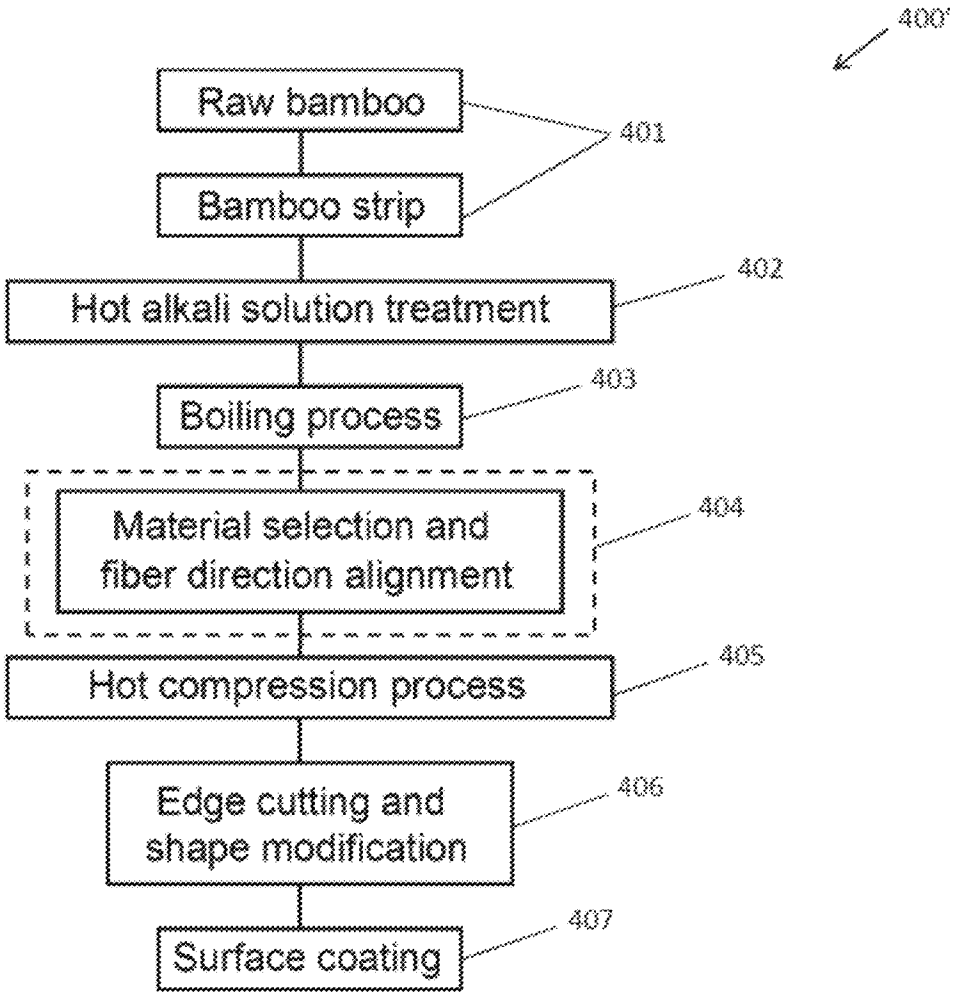
FIG. 4*b* shows a flow chart of the manufacturing process of composite material shown in FIG. 2.

Turning now to FIGS. 4*a* and 4*b* for the detailed description of the methods 400, 400' of forming aforementioned composite materials 100 and 200.

Initially, a bamboo pipe 301 as depicted in FIG. 3 is split into usable sections by machine and the inner and outer bamboo of these sections will be removed in step 401 to form a bamboo strip as depicted in FIG. 5*a*. Bamboo strips with the similar geometry will be retained and grouped together for further processing.

After initial preparation, the bamboo strips 112 will be immersed in a boiling alkali solution of mixed NaOH and $Na_2SO_3$ solution for 6-10 hours, preferably 7 hours to partially remove the lignin 142 and hemicellulose 144 as depicted in FIG. 5*b* in step 402. The immersing time depends on the strip size of the bamboo 300. The time period may also be adjusted to suit different species of bamboos.

Upon the completion of immersion, the bamboo strips 112 will be further immersed in boiling deionized water or boiled in deionized water to remove the residual chemical solution several times, preferably 3 times in step 403 to remove the chemical. After immersing, the bamboo fibres 130 and parenchyma cells 140 may be easily separated and formed.

Figure 5C:
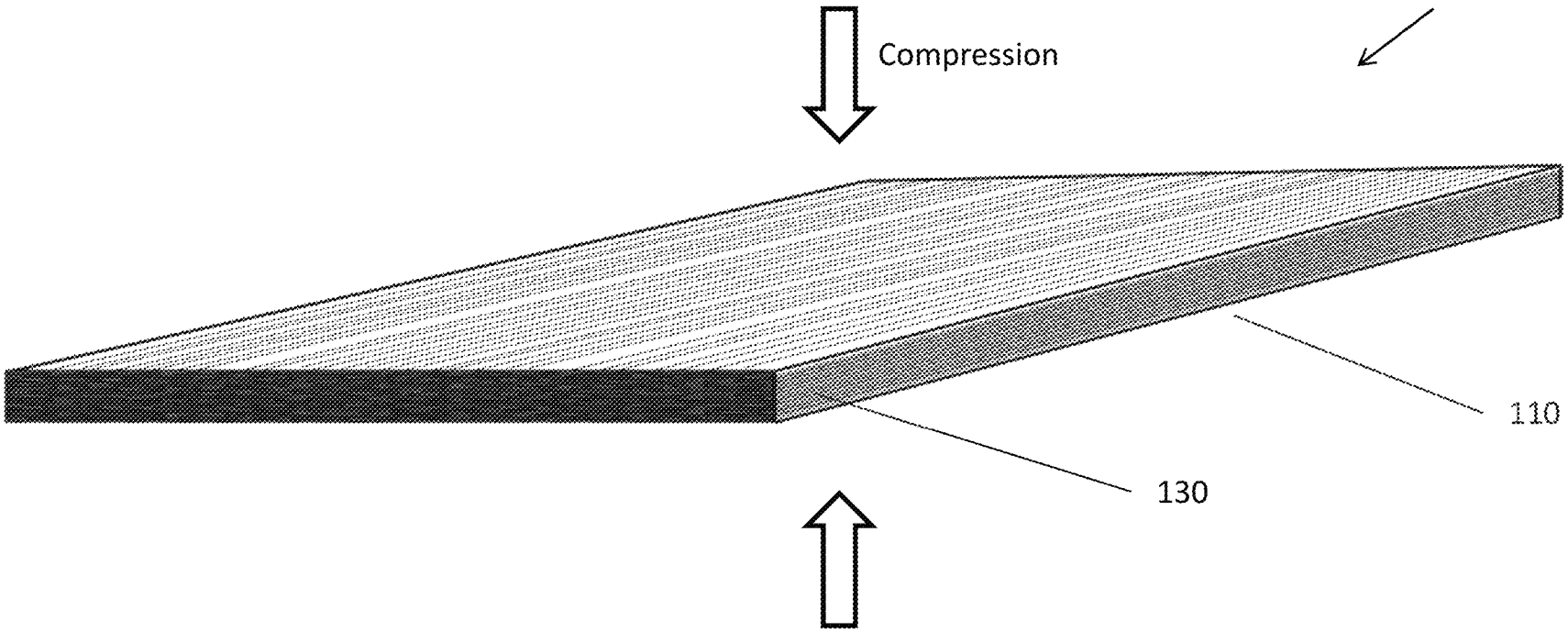
FIG. 5*c* displays the hot compression process of a bamboo strip.

Next, the bamboo strip 112 will be put into a suitable mold. The bamboo strips will be pressed at 100-130° C. and preferably at 100° C. under a pressure of about 5 MPa for 24 hours in step 405 to obtain a highly densified bamboo as depicted in FIG. 5*c* i.e. the composite material 100 in FIG. 1.

To form the laminated composite material 200 in FIG. 2, additional steps are performed following the partial removal of parenchyma cells 140 in steps 402 and 103 and prior to the hot compression process of the substrates 112 in step 405.

Figure 5D:
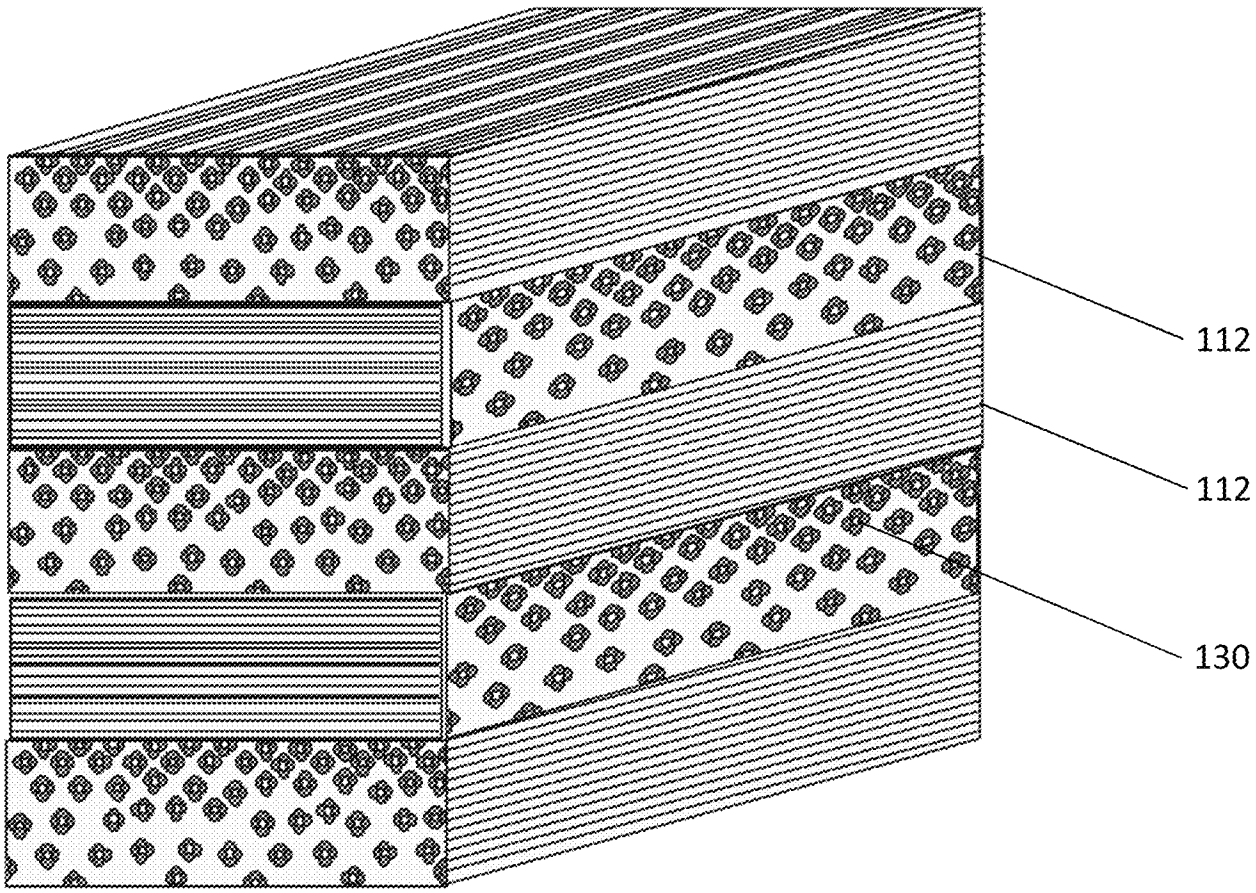
FIG. 5*d* displays multilayer bamboo with bamboo fibre orientation alternating by 90° from layer to layer were laminated.
Figure 5E:
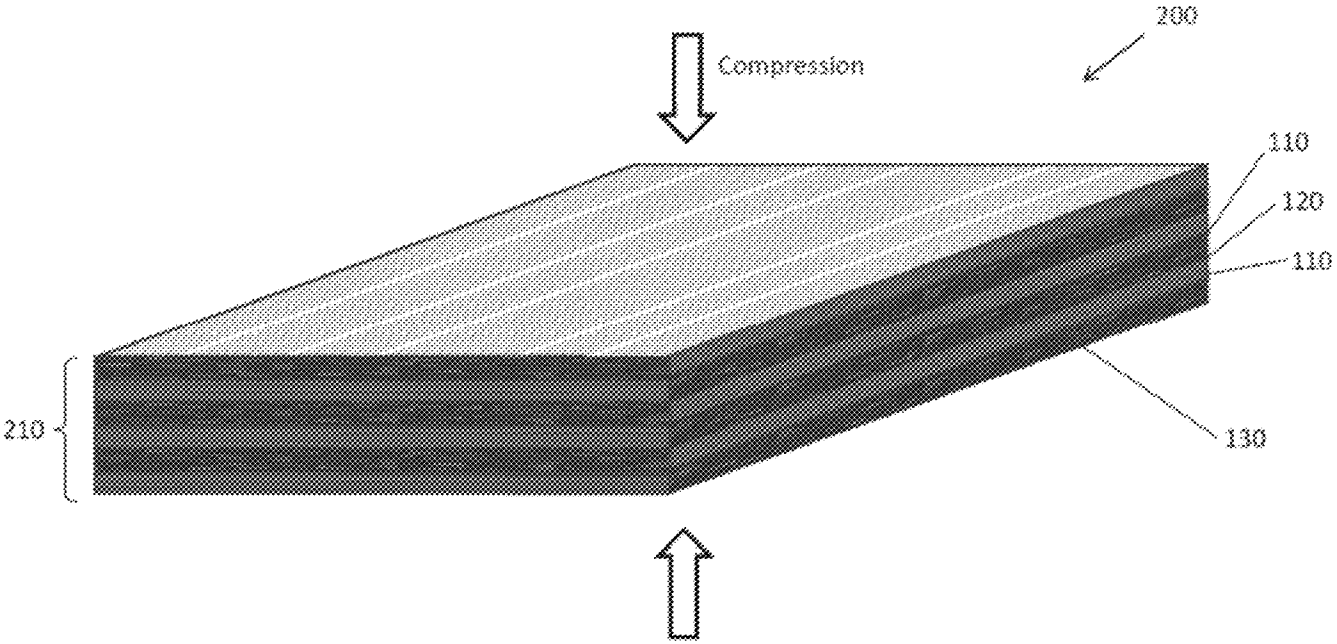
FIG. 5*e* shows the hot compression process for multilayer bamboo.
Figure 5F:
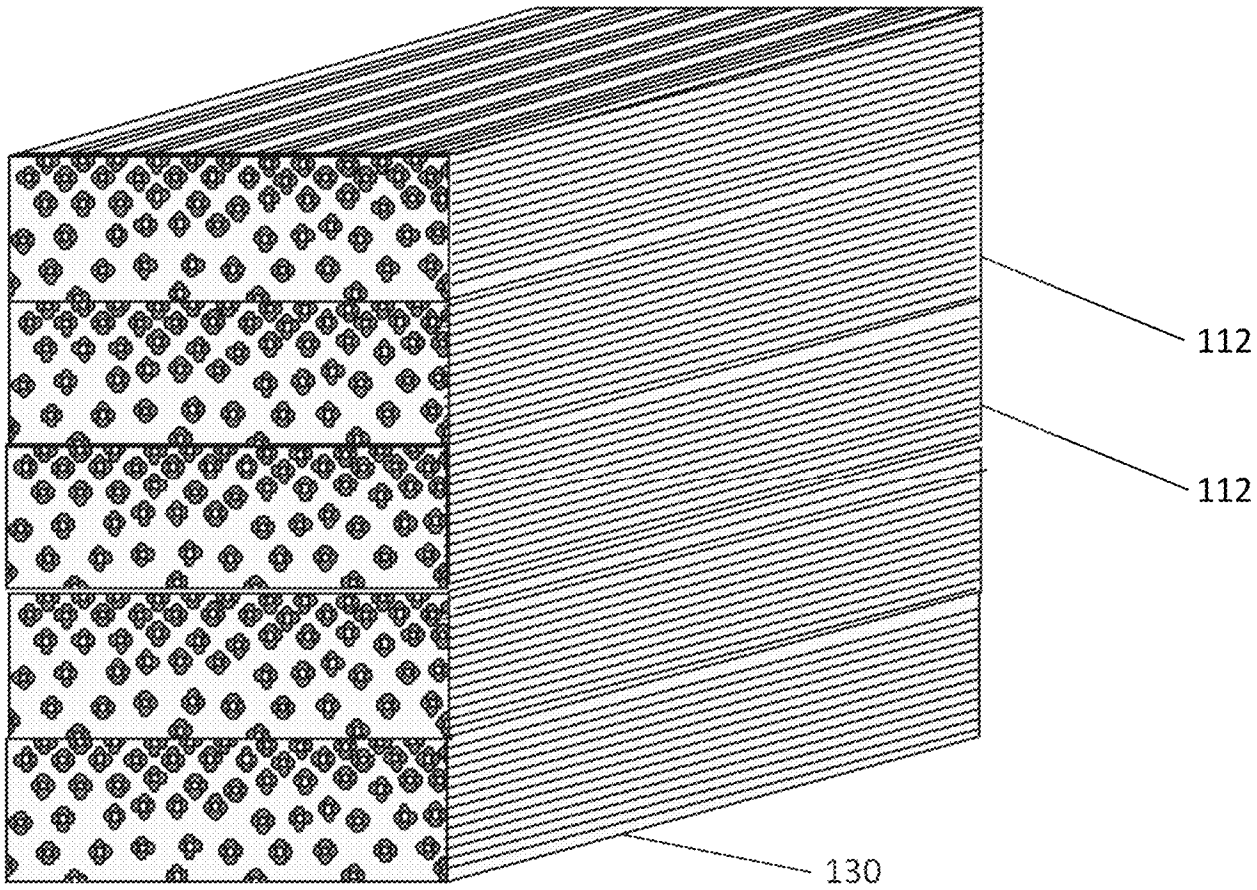
FIG. 5*f* displays multilayer bamboo with bamboo fibre orientation alternating by 0° from layer to layer were laminated.

Referring to FIG. 4*b*, before compression of multiple strips 112, the bamboo strips 112 will be aligned with fibre orientation alternating by 0° (as shown in FIG. 5*d*) or 90° (as shown in FIG. 5*f*) from layer 112 to layer 112 in step 404.

Figure 5G:
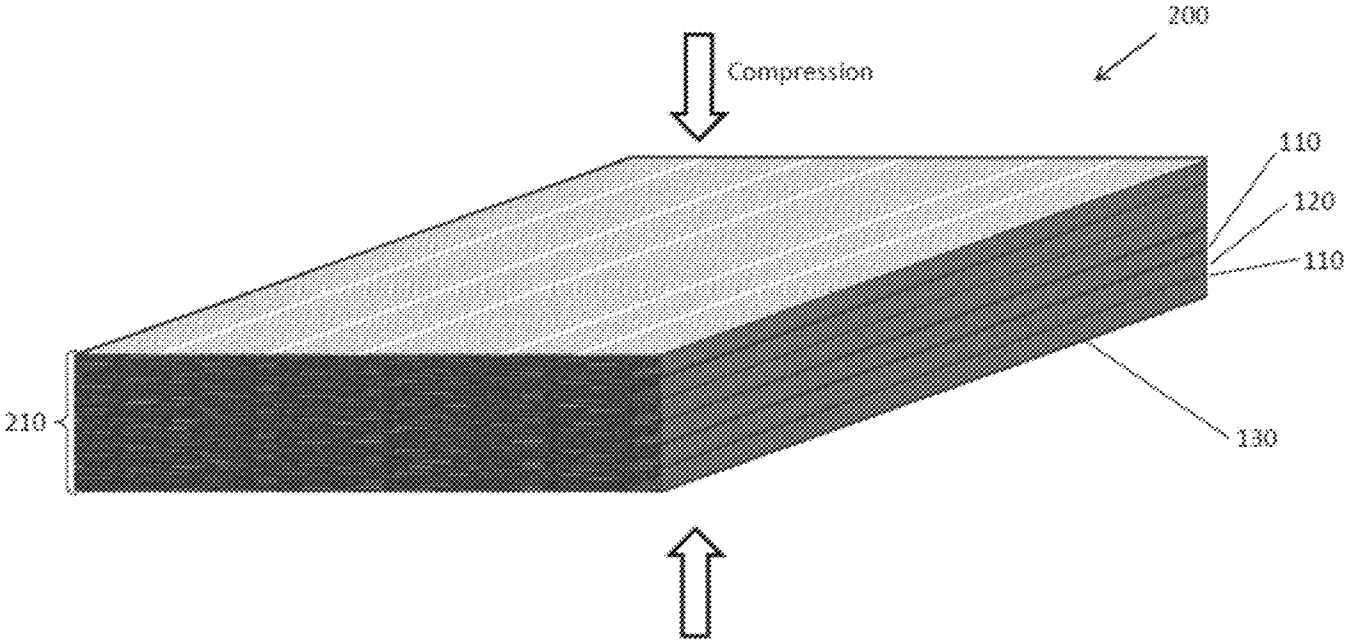
FIG. 5*g* shows the hot compression process for alternative multilayer bamboo.

All the aligned bamboo strips 112 will then be put into the same mold. The bamboo strips 112 will be pressed at 100-130° C. and preferably at 100° C. under a pressure of about 5 MPa for 24 hours in step 405 to obtain a highly densified bamboo as depicted in FIG. 5*e* or 5*g*.

After fully compressed and dried in the mold, the edge of the workpiece 210 is deburred in step 406. This ensures that a work-piece without any sharp edges would be obtained from the densified process. Finally, a thin layer of oil-based painting 150 against moisture will be coated on the surface in step 407.

Advantageously, the chemical and mechanical treatments involved in the present method of forming the present highly densified bamboo material is low cost, environmentally-friendly, and yet the end product bamboo materials possess excellent mechanical properties. For instance, the composite material panel with fibre density of at least 1300 kg/m$^3$ has strength and toughness comparable to traditional metal, alloy or polymers.

The present invention has wide applications across different technical field. For instance, this highly scalable densified bamboo product can be potentially used as the load-bearing part to replace metals/alloys in construction and many other fields. It also can be used as construction material and anti-bending/bulking furniture, such as wall panels and structural components in various furniture and tools.

The present process leads to the total collapse of cell walls and the complete densification of natural bamboo with highly aligned bamboo fibres. The mechanical performance is much higher than the current product using existing method. This method helps to expand application range as well as the market demand.

Essentially, the present invention may omit the use of any additional glue. The highly scalable densified bamboo is manufactured through a special process which uses 100% of the bamboo. The bonding strength of bamboo strips are provided by hydrogen bond formed between neighboring nanofibers.

The process can be applied to any quality/size bamboo for manufacture a high-quality product. To achieve excellent mechanical performance, parameters such as the pressing pressure and pressing time may be adjusted depending on the content of bamboo fibres and parenchyma cells. The present invention would accommodate most of the bamboo culm and minimise the waste of raw bamboo materials.

It will be appreciated by persons skilled in the art that numerous variations and/or modifications may be made to the invention as shown in the specific embodiments without departing from the spirit or scope of the disclosure as broadly described. The present embodiments are, therefore, to be considered in all respects as illustrative and not restrictive.

It is to be understood that, if any prior art information is referred to herein, such reference does not constitute an admission that the information forms a part of the common general knowledge in the art, in any other country.

The invention claimed is:

1. A method of forming a composite material comprising:

a) providing with at least two substrates having fibres, lignin and hemicellulose;

b) partially removing the lignin and hemicellulose from the at least two substrates;

c) aligning the at least two substrates remaining after step b) in a stacked manner to form stacked substrates; and ; and d) compressing the stacked substrates to form a compressed substrate with densified fibres so as to reinforce the strength of the composite material.

2. A method of forming a composite material in accordance with claim 1, wherein step b) includes step b1) of subjecting the at least two substrates to an alkaline condition.

3. A method of forming a composite material in accordance with claim 2, wherein step b1) includes immersing the at least two substrates in an alkaline solution.

4. A method of forming a composite material in accordance with claim 3, wherein the substrate is immersed in a mixture of NaOH and $Na_2SO_3$ for 6-10 hours.

5. A method of forming a composite material in accordance with claim 2, wherein step b) includes step b2), following step b1), of removing the alkali from the substrate for separating the lignin and hemicellulose from the fibres.

6. A method of forming a composite material in accordance with claim 5, wherein the substrate is immersed into a boiling deionized water for at least 3 times.

7. A method of forming a composite material in accordance with claim 1, wherein step c) includes step c1) of stacking one of the two substrates onto the other with the fibres oriented substantially in a parallel arrangement.

8. A method of forming a composite material in accordance with claim 1, wherein step c) includes step c2) of stacking one of the two substrates onto the other with the fibres oriented substantially in a staggered arrangement.

9. A method of forming a composite material in accordance with claim 1, wherein step d) includes step d1) of pressing the substrates under a heated condition.

10. A method of forming a composite material in accordance with claim 9, wherein the stacked substrates are pressed at a temperature of between 100-130° C. under a pressure of 5 MPa for 24 hours.

11. A method of forming a composite material in accordance with claim 1, wherein step c) comprises the step of facilitating formation of hydrogen bonds between adjacent fibres so as to bond the stacked substrates together.

12. A method of forming a composite material in accordance with claim 1, further including step e), following step d), of deburring an edge of the compressed substrate.

13. A method of forming a composite material in accordance with claim 12, further including step f), following step e), of applying an oil coating onto.

14. A method of forming a composite material comprising:

a) providing at least two substrates having fibres, lignin and hemicellulose;

b) partially removing the lignin and hemicellulose from the at least two substrates; and c) compressing the at least two substrates to form a compressed substrate with densified fibres so as to reinforce the strength of the composite material wherein step b) includes a step b1) of immersing at least two substrates under an alkaline condition, wherein the at least two substrates are immersed in a mixture of NaOH and $Na_2SO_3$ for 6-10 hours.

15. A method of forming a composite material in accordance with claim 14, wherein step c) includes a step c1) of pressing the at least two substrates under a heated condition.

16. A method of forming a composite material in accordance with claim 14, further including step d), following step b), of aligning at least two said substrates in a stacked manner.

17. A method of forming a composite material in accordance with claim 16, wherein step d) comprises the step of facilitating formation of hydrogen bonds between adjacent fibres so as to bond the stacked substrates together.

18. A method of forming a composite material in accordance with claim 14, further including step e), following step c), of deburring an edge of the compressed substrate.

19. A method of forming a composite material in accordance with claim 14, further including step f), following step c), of applying an oil coating onto a surface of the compressed substrate.

20. A method of forming a composite material comprising:

a) providing at least two substrates having fibres, lignin and hemicellulose;

b) partially removing the lignin and hemicellulose from the at least two substrates; and c) compressing the at least two substrates to form a compressed substrate with densified fibres so as to reinforce the strength of the composite material, wherein step b) includes the steps of:

b1) of immersing the at least two substrates under an alkaline condition; and b2) following step b1), of removing the alkali from the at least two substrates for separating the lignin and hemicellulose from the fibres, by immersing the at least two substrates into a boiling deionized water at least 3 times.

21. A method of forming a composite material in accordance with claim 20, wherein step c) includes step c1) of pressing the at least two substrates under a heated condition.

22. A method of forming a composite material in accordance with claim 20, further including step d), following step b), of aligning the at least two said substrates in a stacked manner.

23. A method of forming a composite material in accordance with claim 22, wherein step d) comprises the step of facilitating formation of hydrogen bonds between adjacent fibres so as to bond the stacked substrates together.

24. A method of forming a composite material in accordance with claim 20, further including step e), following step c), of deburring an edge of the compressed substrate.

25. A method of forming a composite material in accordance with claim 20, further including step f), following step c), of applying an oil coating onto a surface of the compressed substrate.

* * * * *